US009464518B2

(12) United States Patent
Schwanz et al.

(10) Patent No.: US 9,464,518 B2
(45) Date of Patent: Oct. 11, 2016

(54) METHOD AND DEVICE FOR PRODUCING AND MEASURING A BOREHOLE

(71) Applicant: BAUER SPEZIALTIEFBAU GMBH, Schrobenhausen (DE)

(72) Inventors: Christoph Schwanz, Schrobenhausen (DE); Ulli Wiedenmann, Schrobenhausen (DE)

(73) Assignee: BAUER SPEZIALTIEFBAU GmbH, Schrobenhausen (DE)

( * ) Notice: Subject to any disclaimer, the term of this patent is extended or adjusted under 35 U.S.C. 154(b) by 292 days.

(21) Appl. No.: 13/950,162

(22) Filed: Jul. 24, 2013

(65) Prior Publication Data

US 2014/0041447 A1 Feb. 13, 2014

(30) Foreign Application Priority Data

Aug. 13, 2012 (EP) ..... 12005850

(51) Int. Cl.

| | |
|---|---|
| ***E21B 47/00*** | (2012.01) |
| ***E21B 47/04*** | (2012.01) |
| ***E21B 47/022*** | (2012.01) |
| ***E21B 47/02*** | (2006.01) |

(52) U.S. Cl.

CPC ..... *E21B 47/04* (2013.01); *E21B 47/0006* (2013.01); *E21B 47/02* (2013.01); *E21B 47/02224* (2013.01)

(58) Field of Classification Search

CPC ..... G01B 7/26; G01B 47/09; G01B 47/022; G01B 47/024; G01B 47/0228; G01B 47/0232; E21B 47/04; E21B 47/02; E21B 47/0006; E21B 47/022; E21B 47/02224

USPC ..... 73/152.48

See application file for complete search history.

(56) References Cited

U.S. PATENT DOCUMENTS

| | | | |
|---|---|---|---|
| 1,911,645 | A | 5/1933 | Peterson |
| 1,999,201 | A | 4/1935 | Nichols |
| 2,675,627 | A | 4/1954 | Hinchman |

(Continued)

FOREIGN PATENT DOCUMENTS

| | | | |
|---|---|---|---|
| CN | 102220839 | A | 10/2011 |
| CN | 102287182 | A | 12/2011 |

(Continued)

OTHER PUBLICATIONS

Larson Edwards, Calculus Early Transcendental Functions, 2010, 5th Edition, Chapter 11.*

(Continued)

*Primary Examiner* — Michael A Lyons
*Assistant Examiner* — David L Singer
(74) *Attorney, Agent, or Firm* — Studebaker & Brackett PC

(57) ABSTRACT

A method and a device for producing and measuring a borehole in the ground is provided, in that the borehole is produced through drilling, that between a carrier unit above a ground surface and a measuring body a measuring rope is tensioned, that the measuring body is inserted so as to fit into the borehole in the ground and lowered, that by means of angle and distance measurements the positions of at least two vertically spaced rope points of the tensioned measuring rope are ascertained and in that on the basis of the ascertained positions of the rope points the position of the measuring body in the borehole is determined as a measure for the location of the borehole.

13 Claims, 2 Drawing Sheets

(56) References Cited

U.S. PATENT DOCUMENTS

| | | | | | |
|---|---|---|---|---|---|
| 3,517,966 | A * | 6/1970 | Montacie | E21D 9/1093 | 299/1.3 |
| 4,171,578 | A * | 10/1979 | Meador | E21B 47/0002 | 307/121 |
| 4,610,005 | A * | 9/1986 | Utasi | E21B 45/00 | 348/135 |
| 4,812,977 | A | 3/1989 | Hulsing, II | | |
| 4,869,591 | A * | 9/1989 | MacGregor | G01D 5/30 | 356/138 |
| 5,107,705 | A * | 4/1992 | Wraight | E21B 19/20 | 348/85 |
| 5,204,731 | A * | 4/1993 | Tanaka et al. | 356/3.09 | |
| 2006/0060386 | A1* | 3/2006 | Reich | 175/323 | |
| 2008/0035324 | A1* | 2/2008 | Ciglenec | E21B 19/02 | 166/64 |
| 2010/0295006 | A1* | 11/2010 | Hwang et al. | 254/338 | |
| 2012/0072081 | A1 | 3/2012 | Lanzl et al. | | |

FOREIGN PATENT DOCUMENTS

| | | | | |
|---|---|---|---|---|
| CN | 102418515 | A | 4/2012 | |
| EP | 1108853 | A2 | 6/2001 | |
| EP | 2511659 | A1 * | 10/2012 | G01C 15/002 |
| SU | 135050 | A1 | 11/1960 | |
| SU | 866195 | A1 | 9/1981 | |
| SU | 1768752 | A1 | 10/1992 | |
| TW | 201005154 | A | 2/2010 | |

OTHER PUBLICATIONS

The search report issued by the Singapore Patent Office on Mar. 7, 2014, which corresponds to Singapore Patent Application No. 201305671-8 and is related to U.S. Appl. No. 13/950,162.

The extended European search report issued on Jan. 28, 2013, which corresponds to EP12005850.8 and is related to U.S. Appl. No. 13/950,162.

* cited by examiner

METHOD AND DEVICE FOR PRODUCING AND MEASURING A BOREHOLE

FIELD OF THE INVENTION

The invention relates to a method for producing and measuring a borehole in the ground and to an arrangement for producing and measuring a borehole in the ground.

DESCRIPTION OF RELATED ART

When producing a borehole in the ground, deviations from a desired alignment or location of the borehole can occur due to various influencing factors. Especially in the production of a bored pile wall for instance, in which several bored piles are produced adjacent to each other by filling a borehole, a precise alignment of the individual bored piles is necessary in order to ensure the desired leak-tightness of the bored pile wall. Hence, for each individual borehole it must be ensured that this runs precisely along a predetermined direction.

SUMMARY OF THE INVENTION

The invention is based on the object to provide a method and an arrangement for producing and measuring a borehole in the ground which enable a reliable production and measurement of the borehole.

In accordance with the invention the object is achieved by a method having the features of claim 1 and by a device having the features of claim 9. Preferred embodiments of the invention are stated in the respective dependent claims.

According to the invention the method is characterized in that the borehole is produced through drilling, that between a carrier unit above a ground surface and a measuring body a measuring rope is tensioned, that the measuring body is inserted so as to fit into the borehole in the ground and lowered, that by means of angle and distance measurements the positions of at least two vertically spaced rope points of the tensioned measuring rope are ascertained and in that on the basis of the ascertained positions of the rope points the position of the measuring body in the borehole is determined as a measure for the location of the borehole.

The arrangement for producing and measuring the borehole in the ground is characterized in accordance with the invention in that a drilling tool drivable in a rotating manner is provided for producing the borehole, that a measuring body is provided which can be inserted so as to fit into the borehole and lowered, wherein the measuring body is in contact with a borehole wall, that a measuring rope is provided which can be tensioned between a linkage point on a carrier unit above a ground surface and the measuring body in the borehole, that a measuring device is provided, through which the positions of at least two vertically spaced rope points of the tensioned measuring rope can be ascertained by means of angle and distance measurements and that an evaluation means is provided, with which, as a measure for the location of the borehole, the position of the measuring body in the borehole can be determined on the basis of the ascertained positions of the rope points.

A first fundamental idea of the invention can be seen in the fact that between the carrier unit above the ground surface and the measuring body in the borehole a measuring rope is tensioned. The alignment of the measuring rope in space is ascertained. Based on the ascertained alignment of the measuring rope, the position of the measuring body in the borehole and thus the position of a corresponding section of the borehole is determined.

According to the invention the spatial positions of at least two rope points of the measuring rope are determined. Basically, these rope points can be selected freely, arranged preferably, however, above the ground surface. Between the mutually spaced rope points a mathematical vector is spanned, the alignment of which is used to determine the position of the measuring body.

By tensioning the measuring rope a course of the measuring rope along a straight line is ensured so that the linkage point of the rope on the measuring body is situated in the extension of the vector spanned by the rope points. The vector between the rope points is extrapolated up as far as the measuring body and in this way the position of the measuring body is determined.

Providing that the measuring rope runs in a straight line, by way of the direction of extension of the measuring rope and the position of a rope point with respect to a given reference point, the position of the measuring body or of the linkage point of the measuring rope on the measuring body can be determined.

In a preferred embodiment of the method according to the invention at least two measuring ropes are tensioned between the measuring body and the carrier unit. The arrangement of several measuring ropes makes it possible not only to determine the sheer position of the measuring body but also its spatial alignment. In particular, by way of several measuring ropes a lateral tilting of the measuring body, especially a deviation from the vertical can be detected.

To determine a depth profile or a course of the borehole at least two positions of the measuring body are preferably determined at different depths in the borehole. It is particularly preferred that a first position of the measuring body is determined in the area of a drill start, i.e. at the upper end of the borehole, and a second position of the measuring body is determined at a given depth below the drill start. Through this, a deviation or an offset of the borehole from the drill start can be reliably detected.

Furthermore, in accordance with the invention it is preferred that in addition to the positions of the rope points a depth location of the measuring body is determined. Based on the known depth location and the known vector between the rope points the position of the measuring body in the borehole can be calculated precisely. The depth location of the measuring body can be ascertained, for example, by way of a measuring means on the measuring body or by determining the rope length on the basis of a reference point. The rope length of the measuring rope between a known reference point, for instance situated on the carrier unit, and the linkage point on the measuring body can be determined, for example, by a length unwound from a rope winch.

In an advantageous embodiment of the method provision is made in that a drilling tool which is used for producing the borehole is withdrawn from the borehole and that after withdrawal from the borehole the drilling tool is pivoted out of a borehole axis and the separate measuring body is pivoted into the borehole axis. The measuring body can then be inserted along the borehole axis into the borehole and lowered therein. By preference, both the drilling tool and the measuring body are held by a pivotable mast of the carrier unit and can be pivoted out of the borehole axis or into the borehole axis through a pivoting motion of the mast. The insertion of the measuring body into the produced borehole can therefore be effected in an especially simple manner.

In a further preferred embodiment use is not made of a separate measuring body but the measuring body is constituted by the drilling tool which is employed for producing the borehole. In the borehole, the drilling tool makes contact with the borehole wall and is therefore centered within the borehole. It is thus forcibly fitted into place in the borehole so that the position of the drilling tool in the borehole reliably represents the location of the borehole at the relevant place.

When using a combined or integrated drilling tool and measuring body it is preferred that the drilling tool is withdrawn from the borehole and that subsequently the measuring rope is fixed on the drilling tool and the drilling tool with the measuring rope fixed thereon is lowered again into the borehole in order to measure the borehole. Hence, in a first method step the drilling tool serves for the production of the borehole and in a second method step it serves as a measuring body for measuring the borehole. In the second method step the drilling tool is preferably not driven in a rotating manner. By preference, the determination of position of the drilling tool in the borehole takes place when the drilling tool is at a standstill.

It is preferred that during the drilling process the measuring rope is detached from the drilling tool, which constitutes the measuring body at the same time, and is stowed away on the carrier unit. After withdrawal of the drilling tool from the borehole the measuring rope is fixed on the drilling tool, the drilling tool is lowered again into the borehole and the measuring rope is tensioned.

According to another preferred embodiment the borehole is filled with a hardenable medium in order to produce a pile in the ground. For the production of a bored pile wall several boreholes can be produced side-by-side in an overlapping manner and filled with a hardenable medium.

With regard to the arrangement according to the invention it is preferred that the measuring body has a body with a diameter corresponding to the borehole. This ensures an accurately fitting insertion and alignment of the measuring body in the borehole. An accurately fitting or defined position of the measuring body in the borehole is understood, in particular, as an arrangement, in which the measuring body, by making contact with the borehole wall, is arranged in a defined manner, more particularly centered in the borehole cross-section so that the location of the measuring body permits a direct conclusion as to the corresponding borehole section.

The measuring rope can be tensioned, for example, in that the carrier unit has a mast and a sledge supported in a movable manner on the mast and in that a linkage point for the measuring rope is arranged on the sledge supported in a movable manner along the mast. Hence, through an upward movement of the sledge along the mast, for example, the measuring rope can be tensioned between the linkage point on the sledge and the opposite lying linkage point on the measuring body. The linkage point on the sledge can be constituted by a fixed point, a deflection pulley or a rope winch for example.

By preference, the sledge movable along the mast has a drill drive for driving a drill rod in a rotating manner. The linkage point for the measuring rope is preferably provided on a non-rotating part of the sledge, for instance on a base body of the sledge or a housing of the drill drive.

According to the invention the insertion of the measuring body into the borehole can be facilitated in that the carrier unit has a mast, that the mast is supported in a pivotable manner on a base and in that through a pivoting of the mast the drilling tool for producing the borehole or the separate measuring body can be optionally arranged in a borehole axis of the borehole. The base of the carrier unit can be a carrier vehicle, for example, that is movable on the ground surface.

In a further preferred embodiment of the arrangement according to the invention the measuring body is constituted by the drilling tool drivable in a rotating manner. The measuring rope can thus be fixed directly on the drilling tool drivable in a rotating manner, with the measurement of the borehole being preferably carried out when the drilling tool is at a standstill. For the purpose of measuring the borehole the drilling tool can initially be withdrawn from the borehole. Afterwards, the measuring rope can be fixed on the drilling tool and the latter can be lowered into the borehole again in order to carry out a measurement. To this end, the measuring rope can preferably be fixed on the drilling tool in a detachable manner, i.e. temporarily.

According to another preferred embodiment a winch is provided for receiving the measuring rope. The winch can be arranged on the carrier unit, in particular on its base or mast, or on a separate unit next to the carrier unit. On the mast the winch can be fixed by way of a cross-member. In addition to permitting the secure reception of the measuring rope, especially in-between single measurements of the borehole or during the drilling process, the winch also allows for a reliable tensioning of the measuring rope by winding the measuring rope onto the rope winch.

In a further preferred embodiment the measuring rope is guided via a deflection pulley situated, in particular, on the sledge. In this way, the measuring rope can be guided for example from a rope winch on the base of the carrier unit via the deflection pulley on the sledge into the borehole axis. Here, the deflection pulley on the sledge constitutes a linkage point of the measuring rope on the sledge.

In an advantageous embodiment of the invention the measuring device is arranged on or above the ground surface with unobstructed view of the measuring rope. The measuring device locates the measuring rope and, by making use of at least two measured values, ascertains the location of the rope in space. The two measuring points are situated at different heights above the ground surface.

In accordance with the invention it is preferred that for angle and distance measurement a measuring device is used that permits angle measurements in the vertical as well as horizontal direction and, in addition, the measurement of a distance. By preference, a tachymeter is used as a measuring device. The measuring rope is sighted optically by the tachymeter.

To determine the position of the located rope point the measuring device emits an electromagnetic beam, for example a light beam that is reflected by the located rope point. Basically, the rope point can be any chosen point on the measuring rope. A measurement of the distance of the rope point to the measuring device is carried out, for instance by means of running time measurement or phase shift. Furthermore, the angle of the light beam directed onto the rope point is determined with respect to a given reference axis. As a result of the distance and angle measurement thus carried out it is possible to determine the position of the located rope point in space. The ascertainment of the position of the at least one further rope point is carried out in the same way.

Preferably, the light beam is light in the infrared range and by preference a laser beam. To locate the rope points e.g. the rope center can be sighted using a crosshairs of the tachymeter for example. By preference, the sighting is not carried out until the ropes are steadied, i.e. preferably when the ropes are at a standstill.

BRIEF DESCRIPTION OF THE DRAWINGS

In the following the invention is described further by way of preferred embodiments illustrated in the accompanying schematic drawings, wherein shows.

In all Figures identical components or those having the same effect are designated with the same reference signs.

DETAILED DESCRIPTION OF THE PREFERRED EMBODIMENT

Figure 1:
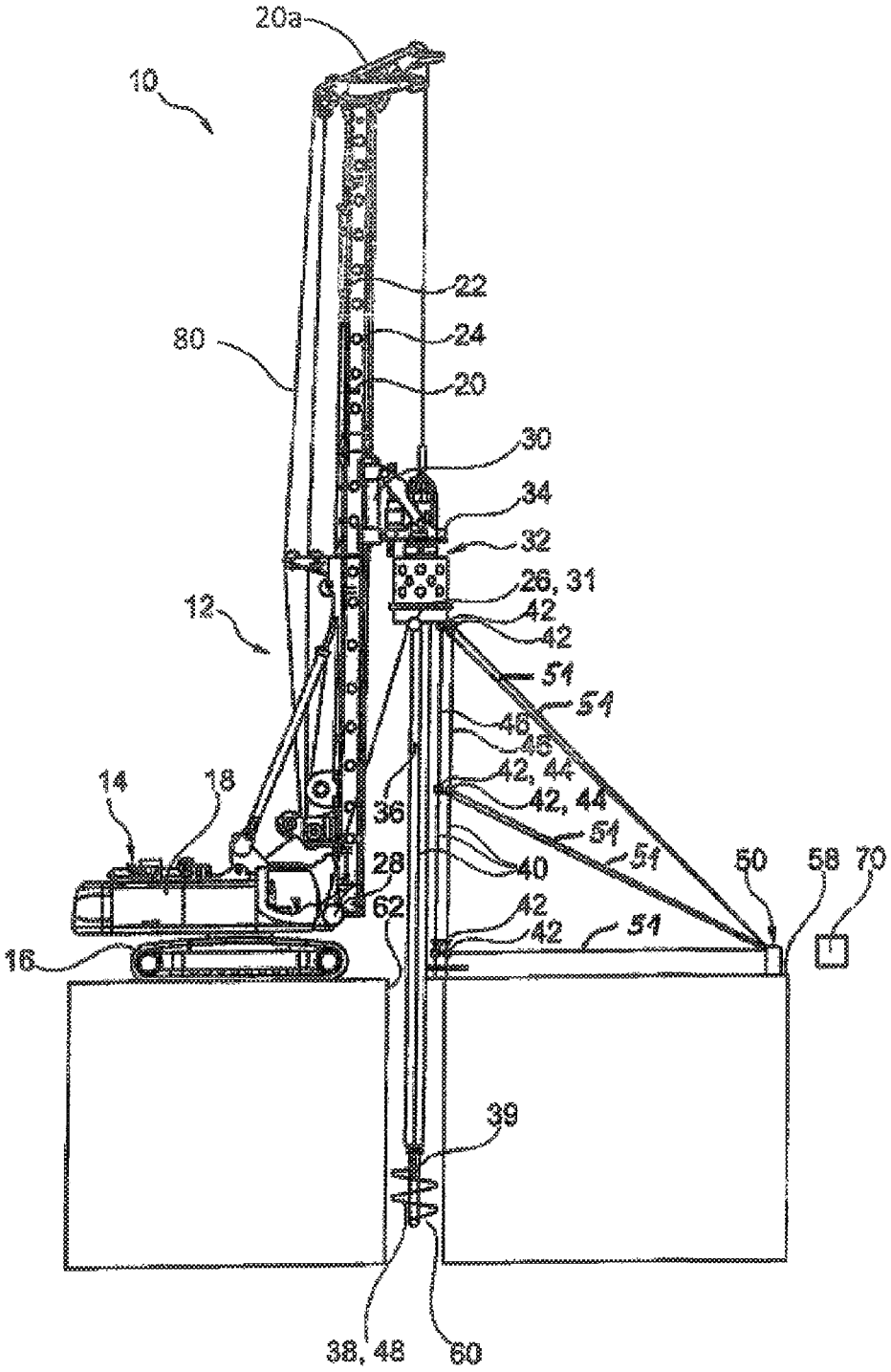
FIG. 1: a first embodiment of an arrangement according to the invention.

A first embodiment of an arrangement 10 according to the invention for producing and measuring a borehole 60 is shown in FIG. 1. The arrangement 10 comprises a carrier unit 12, in particular a drilling apparatus, with a base 14, a mast 20 having a mast head 20*a*, a main rope 80, and a sledge 30. In the illustrated embodiment the base 14 is constituted by a carrier vehicle, comprising an undercarriage 16 and an upper carriage 18 supported in a rotatable manner on the undercarriage 16 about a vertical axis of rotation.

The mast 20 is pivotably supported on the base 14. Along a mast axis 22 guide rails 24 are provided, on which the sledge 30 is guided in a movable manner. The sledge 30 comprises a drill drive 32 with a housing 34. A drill rod 36, at the lower end of which a drilling tool 38 is arranged, is drivable in a rotating manner by the drill drive 32.

Between the carrier unit 12 and the drilling tool 38 a measuring rope 40 is tensioned. Starting off from a winch 28 on the base 14 of the carrier unit 12, the measuring rope 40 is guided via a deflection pulley 26 on the sledge 30 to the drilling tool 38. The deflection pulley 26 is situated on the drill drive 32, which is a rotary drive head in particular, and constitutes an upper linkage point 31 for the measuring rope 40. On the drilling tool 38 a lower linkage point 39 is provided. From the deflection pulley 26 the measuring rope 40 is guided downwards. A straight connecting line between the upper linkage point 31 and the lower linkage point 39 runs parallel to the drill string or drill rod 36. The measuring rope 40 can be a steel rope in particular. In principle, provision can also be made for several measuring ropes 40, especially two measuring ropes 40, as shown schematically in FIG. 1 on the right side of the drill rod.

Arranged at a distance from the carrier unit 12 above a ground surface 58 is a measuring device 50 that can be a tachymeter in particular. By means of the measuring device 50 rope points 42 can be sighted as shown by lines 51 in particular optically and their spatial positions can be determined as measured values. The measuring or rope points 42 are situated above the ground surface or rather outside or above the borehole 60.

By determining the spatial location of at least two rope points 42 on the measuring rope 40 a vector 46 can be calculated, in the extension of which the linkage point 39 of the measuring rope 40 on the drilling tool 38 is situated. If the depth location of the drilling tool 38 is known, together with the ascertained rope points 42 it is possible to ascertain the precise position of the drilling tool 38.

In the embodiment according to FIG. 1 the drilling tool 38 constitutes a measuring body 48 for measuring the borehole 60. The drilling tool 38 or the measuring body 48 rests against a borehole wall 62 of the borehole 60. Consequently, the drilling tool 38 or the measuring body 48 is arranged in an accurately fitting manner, i.e. at a defined location in the cross-section of the borehole 60. Knowing the position of the drilling tool 38 or the measuring body 48, a conclusion can thus be drawn as to the position of the relevant borehole section.

For measurement checking a further rope point 42 can be determined as a measurement checkpoint 44 between two rope points 42 that are also referred to as measuring points. If all rope points 42 lie on a straight line, it can be assumed that the measuring rope 40 runs all in all in a straight manner.

On the construction site a fixed construction site coordinate system can be installed as a reference system. By preference, the position of the measuring device 50 in relation to the construction site coordinate system is known. The construction site coordinate system can have one or several fixed points as reference points. By preference, the positions of the rope points 42 of the measuring rope 40 can be ascertained in relation to the construction site coordinate system. Through this, it is possible to calculate the spatial position of the drilling tool 38 or the measuring body 48 in relation to the construction site coordinate system. This permits a precise measurement of the produced borehole 60.

For the production and measurement of the borehole 60 the following method steps can be carried out in the embodiment according to FIG. 1:

1. At least a partial area of the borehole 60 is produced by driving the drill rod 36, on which the drilling tool 38 is situated, in a rotating manner.
2. The drilling process is terminated.
3. The measuring rope 40 is fixed on the drilling tool 38, for example a drill flight or a drilling bucket.
4. The drilling tool 38 is moved into the borehole 60 up to an intended measuring depth.
5. Unless already done, the measuring rope 40 is tensioned.
6. Through angle and distance measurements by means of the measuring device 50 the positions of at least two spaced rope points 42 of the measuring rope 40 are determined.
7. The drilling tool 38 is withdrawn from the borehole 60.
8. The measuring rope 40 is removed from the fixed point or linkage point 39 on the drilling tool 38.
9. The drilling process can be continued.

All in all, a measurement of at least one measuring rope 40 is thus effected above the borehole 60 at at least two points. A vector 46 formed between these rope points 42 is transferred to the current drilling depth. In this way, it is possible to obtain an offset from the starting point of drilling up to the measuring depth. The measuring rope 40 guided from the deflection pulley 26 in the downward direction is fixed on the drilling tool 38 on a retaining or linkage point 39 solely for the purpose of a measuring run of the drilling tool 38.

Figure 2:
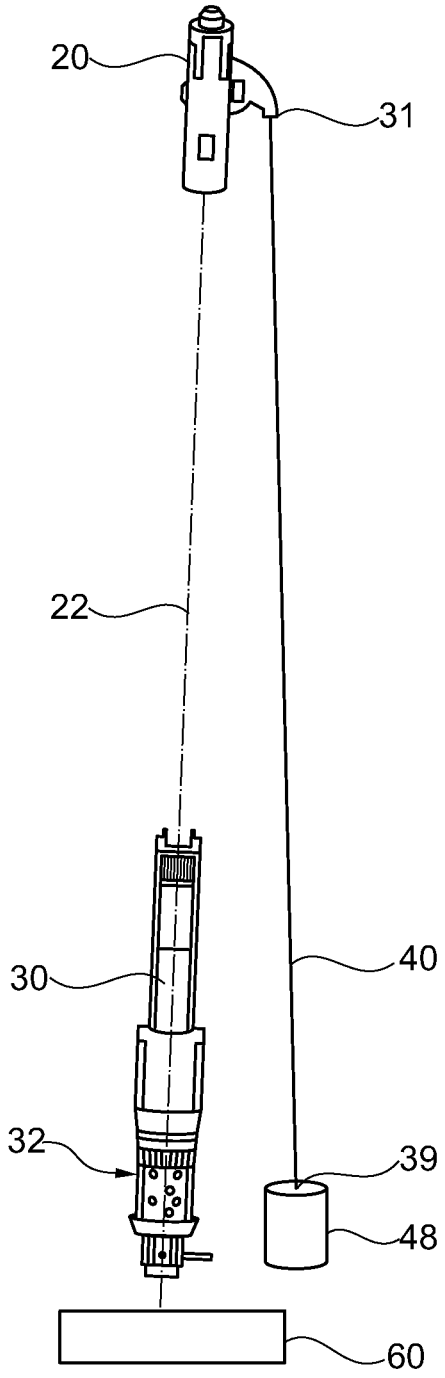
FIG. 2: a second embodiment of an arrangement according to the invention.

A second embodiment of an arrangement according to the invention is shown in FIG. 2. In contrast to the previous embodiment, in this embodiment a separate measuring body 48, which can be a cylindrical body in particular, is used in addition to the drilling tool 38. The measuring body 48 is designed as a measuring bomb in order that the measuring rope 40 is arranged at least almost centrically in the borehole 60 at the desired measuring depth. The linkage point 39 for the measuring rope 40 is situated centrically on the measuring body 48. The drill drive 32 can be pivoted out of the borehole axis so that the separate measuring body 48 can be inserted in place of the drilling tool 38 into the borehole 60.

FIG. 2 shows a state with a pivoted mast axis 22 and a drill drive 32 pivoted out of the borehole axis. The measuring body 48 is suspended by way of a measuring rope 40 on a linkage point 31 on the mast 20. The linkage point 31 is situated next to or offset from an axis of rotation of the drill rod 36.

In the embodiment according to FIG. 2 the following method steps can be carried out for producing and measuring the borehole 60:

1. By driving the drill rod 36, on which the drilling tool 38 is situated, in a rotating manner at least a partial area of the borehole 60 is produced.
2. The drilling process is terminated and the drilling tool 38 is withdrawn from the borehole 60.
3. The drill drive 32 is pivoted out of the borehole axis.
4. A measuring body 48 suspended on the measuring rope 40 is pivoted into the borehole axis.
5. The measuring body 48 is moved into the borehole 60 up to an intended measuring depth.
6. Through angle and distance measurements carried out by means of the measuring device 50 the positions of at least two spaced rope points 42 of the measuring rope 40 are determined.
7. The measuring body 48 is withdrawn from the borehole 60 and pivoted out of the borehole axis.
8. The drill drive 32 is pivoted into the borehole axis.
9. The drilling process can be continued.

For the measurement of several borehole sections the above steps can be repeated at different measuring depths of the measuring body 48. By measuring at least two points of the borehole 60 at different depths a course of the borehole 60 can be determined and in particular a deviation of the borehole 60 from the vertical can be detected. By preference, an upper measuring depth is situated in the area of the drill start, i.e. in an upper area of the borehole 60 close to the ground surface 58.

To calculate the position of the measuring body 48 or the drilling tool 38 on the basis of the rope points 42 an evaluation means 70 is provided.

The invention claimed is:

1. Method for producing and measuring a borehole in the ground, comprising:

producing the borehole through drilling, providing a carrier unit having a mast and a drill drive, providing a main rope and at least one measuring rope, the main rope being guided via a mast head of the mast and holding the drill drive, between the drill drive at the carrier unit above a ground surface and a measuring body, tensioning the at least one measuring rope, the measuring body with the measuring rope being inserted so as to fit into the borehole in the ground and lowered, by means of optical angle and distance measurements, ascertaining positions of at least two vertically spaced rope points on the tensioned measuring rope, determining a depth location of the measuring body, and on the basis of the ascertained positions of the rope points and the depth location of the measuring body, determining a position of the measuring body in the borehole by extrapolating a vector between the rope points up to the depth location of the measuring body as a measure for the location of the borehole.

2. Method according to claim 1, wherein between the measuring body and the drill drive at the carrier unit at least two measuring ropes are tensioned.

3. Method according to claim 1, wherein to determine a course of the borehole at least two positions of the measuring body are determined at different depths in the borehole.

4. Method according to claim 1, wherein a drilling tool which is used for producing the borehole is withdrawn from the borehole and after withdrawal from the borehole the drilling tool is pivoted out of a borehole axis and the measuring body is pivoted into the borehole axis.

5. Method according to claim 1, wherein the measuring body is constituted by a drilling tool which is used for producing the borehole.

6. Method according to claim 5, wherein the drilling tool is withdrawn from the borehole and subsequently the measuring rope is fixed on the drilling tool and the drilling tool with the measuring rope fixed thereon is lowered again into the borehole in order to measure the borehole.

7. Method according to claim 1, wherein the borehole is filled with a hardenable medium in order to produce a pile in the ground.

8. Arrangement for producing and measuring a borehole in the ground, comprising:

a carrier unit provided above a ground surface and having a mast and a drill drive;

a measuring body;

a measuring rope configured to be tensioned between a first linkage point on the drill drive and a drilling tool forming the measuring body;

a main rope which is guided via a mast head of the mast and holds the drill drive;

a measuring device; and an evaluator, wherein the drilling tool drivable in a rotating manner is provided for producing the borehole, the drilling tool with the measuring rope is provided which can be inserted so as to fit into the borehole and lowered, wherein the measuring body is in contact with a borehole wall, the measuring device is provided, through which positions of at least two vertically spaced rope points on the tensioned measuring rope can be ascertained by means of optical angle and distance measurements, the measuring rope is configured to determine a depth location of the measuring body on a basis of a reference point, and the evaluator determines a position of the measuring body in the borehole as a measure for the location of the borehole, by extrapolating a vector between the rope points up to the depth location of the measuring body on the basis of the ascertained positions of the rope points and the depth location of the measuring body.

9. Arrangement according to claim 8, wherein the measuring body has a body with a diameter corresponding to the borehole.

10. Arrangement according to claim 8, wherein the carrier unit has a sledge supported in a movable manner on the mast and the sledge comprises the drill drive, and the measuring rope is tensioned between the first linkage point on the sledge and a second linkage point on the measuring body.

11. Arrangement according to claim 8,
wherein the mast is supported in a pivotable manner on a base and through a pivoting of the mast the drilling tool for producing the borehole or the measuring body can be optionally arranged in a borehole axis of the borehole.

12. Arrangement according to claim 8,
wherein a winch is provided for receiving the measuring rope.

13. Arrangement according to claim 8,
wherein the measuring rope is guided via a deflection pulley.

* * * * *